US005566638A

United States Patent [19]

Rokosny

[11] Patent Number: 5,566,638

[45] Date of Patent: Oct. 22, 1996

[54] COLLAPSIBLE MARKER CONE

[75] Inventor: Gary Rokosny, Piscataway, N.J.

[73] Assignee: Regent Sports Corporation, Hauppauge, N.Y.

[21] Appl. No.: 542,427

[22] Filed: Oct. 13, 1995

Related U.S. Application Data

[63] Continuation of Ser. No. 191,330, Feb. 3, 1994, abandoned.

[51] Int. Cl.[6] ..... E01F 9/00

[52] U.S. Cl. ..... 116/63 C; 404/10

[58] Field of Search ..... 116/63 P, 63 C, 116/63 T, 63 R, 28 R, 209; 40/610, 612; 404/6, 10, 9; D10/109, 111, 113, 114; 359/551, 552

[56] References Cited

U.S. PATENT DOCUMENTS

| | | | |
|---|---|---|---|
| D. 327,231 | 6/1992 | Mazzola | D10/113 |
| 3,081,054 | 3/1963 | Westervelt | 116/28 R |
| 3,521,596 | 7/1970 | Schlein | 116/63 C |
| 3,555,550 | 1/1971 | Walters | D10/109 |
| 4,197,807 | 4/1980 | Campbell | 116/63 P |
| 4,245,050 | 3/1981 | Barnard | 116/63 C |
| 5,036,791 | 8/1991 | Thurston | 116/63 C |
| 5,305,705 | 4/1994 | Gagliano | 116/63 P |

FOREIGN PATENT DOCUMENTS

| | | | |
|---|---|---|---|
| 218771 | 4/1987 | European Pat. Off. | 116/63 C |
| 221128 | 8/1942 | Switzerland | 404/10 |

*Primary Examiner*—Thomas B. Will
*Assistant Examiner*—Andrew Hirshfeld
*Attorney, Agent, or Firm*—Darby & Darby, P.C.

[57] ABSTRACT

A collapsible marker cone for use with sporting events, such as in-line skating, comprising a base and a conical portion. The conical portion is attached to the base along a vertical axis and includes weakened regions such as vertically disposed slots which allow the conical portion to easily collapse, along the vertical axis, when a predetermined force, such as the weight of a falling person, is applied to the marker cone along the vertical axis. The weakened regions allow the conical portion to collapse prior to injuring the falling person.

12 Claims, 2 Drawing Sheets

COLLAPSIBLE MARKER CONE

This is a continuation of application Ser. No. 08/191,330, filed Feb. 3, 1994, now abandoned.

FIELD OF THE INVENTION

This invention generally relates to marker cones similar to those used to direct and warn automobile traffic, and more particularly, to such cones modified for use as markers in sporting events, such as in-line skating and field sports.

BACKGROUND OF THE INVENTION

Safety cones of the type commonly used for automotive traffic signalling and control have previously been modified for use as markers in sporting events. These modified traffic cones are considerably smaller than the conventional automotive cones. The small cones are made from brightly colored rubber or plastic and, like their larger relative, include both a supporting base which is usually square, and a vertically disposed cone. Both the prior art automotive and modified sport marker cones are designed to maintain a vertical orientation unless hit horizontally from the side, either by an automobile or, with the smaller version, a person rolling against the cone. This collapsible structure for horizontal collisions works well with the larger automotive cones to prevent damage to the automobile during accidental impact. However, the structure fails to adequately collapse the cone should it be contacted vertically, such as a person falling directly onto the top of the structure from above. The inherently rigid geometry of a cone allows the marker cone to resist collapse and retain its shape even under application of considerable downward vertical forces. It is likely that a person falling onto the conventional marker will be injured by the impact with the cone before sufficient force is reached to collapse the cone structure.

OBJECTS OF THE INVENTION

It is therefore one object of the present invention to provide a marker cone which overcomes the above-mentioned problems of the prior art.

It is another object of the present invention to provide such a marker cone which is suitable for safe use in sporting events.

It is another object of the present invention to provide a marker cone which collapses under the weight of a falling person thereby avoiding injury to the person regardless of the direction of fall.

It is another object of the present invention to provide a marker cone which is collapsible upon either horizontal or vertical impact.

SUMMARY OF THE INVENTION

The present invention is directed to a collapsible marker cone for use in sporting events, such as soccer, field hockey, football, basketball, ice skating, in-line skating, and the like, comprising a base and a conical portion. The conical portion is attached to the base along a vertical axis and includes vertically disposed slots which allow the conical portion to easily collapse, along the vertical axis, when a predetermined weight, such as the weight of a falling person, is applied to the marker cone along the vertical axis. The slots allow the conical portion to collapse, thereby avoiding injury to the falling person.

DETAILED DESCRIPTION OF THE PREFERRED EMBODIMENT

Figure 1:
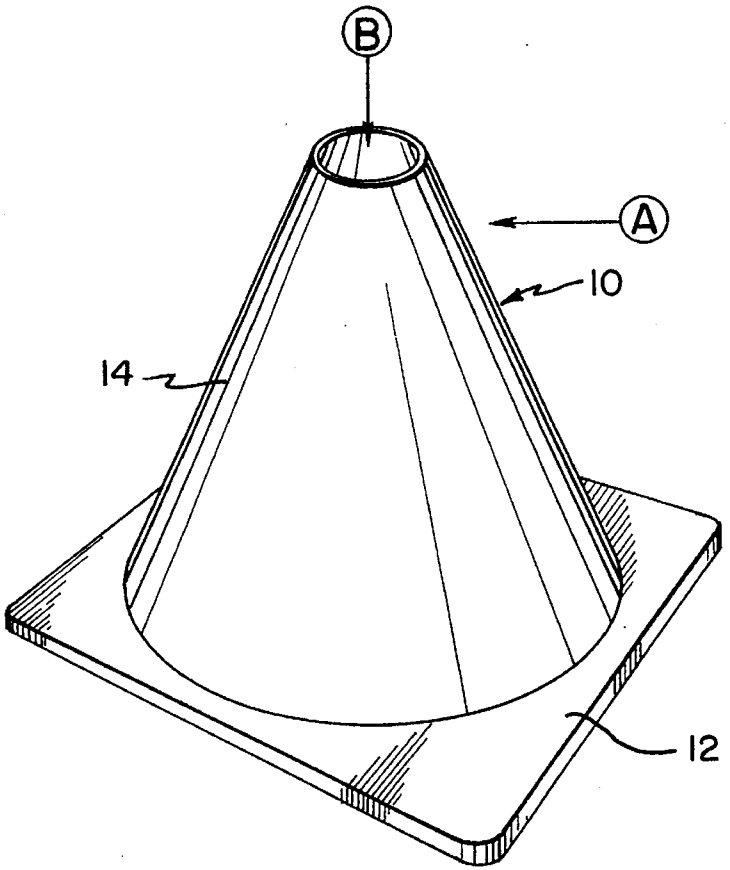
FIG. 1 is a perspective view of a conventional, prior art marker cone.

Referring to FIG. 1, a conventional marker cone 10 is shown. The cone 10 includes a base portion 12, which may be weighted, and a hollow cone portion 14. The conventional marker cone 10 is made from a flexible rubber or plastic material and is optionally colored with an appropriate safety color, usually fluorescent orange.

If a horizontal force A, provided by, for example, a person falling and rolling along the ground, is applied to this conventional cone 10, the structure of the cone portion 14 will fold over, along a crease-line, and will eventually collapse flat, parallel with the base portion 12. However, should a person fall directly on top of the cone portion 14, along force line B, the structural integrity of the conventional cone 10 will be maintained and the cone will not collapse, potentially injuring the falling person.

Figure 2:
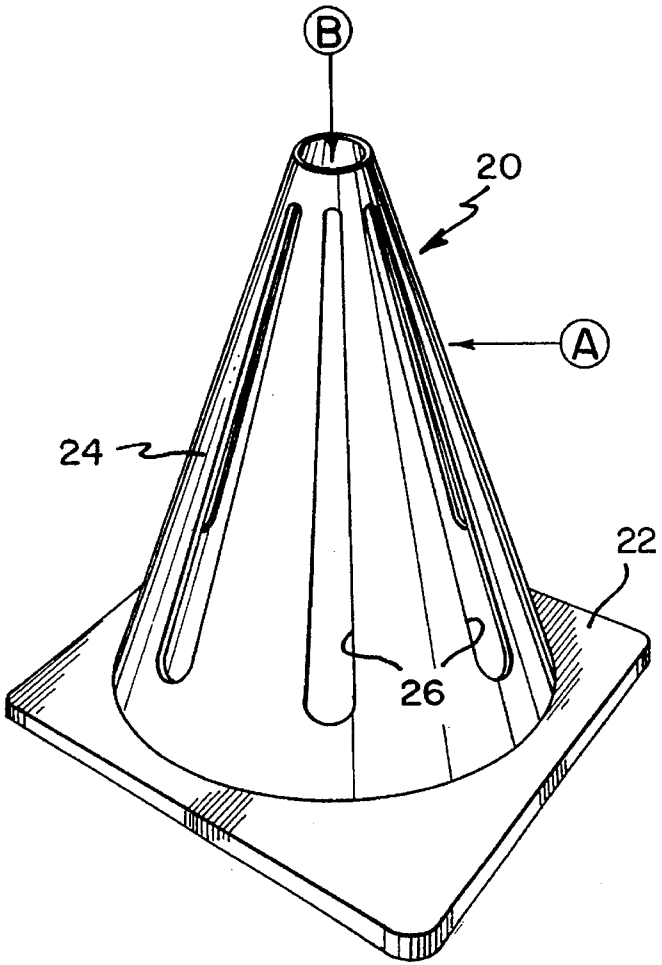
FIG. 2 is a perspective view of a marker cone, in accordance with the invention, shown in an upright, non-collapsed position.
Figure 3:
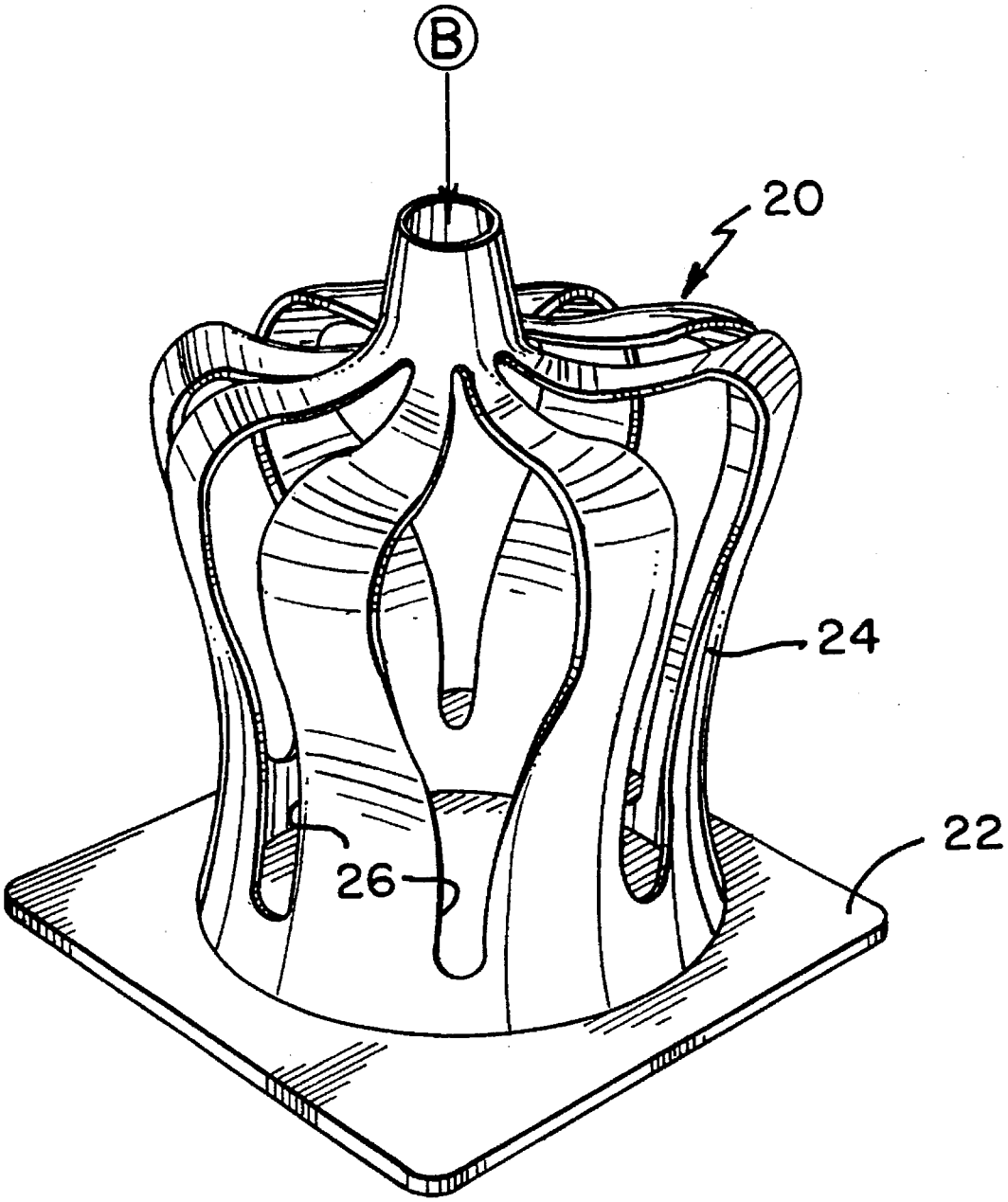
FIG. 3 is a perspective view of the cone shown in FIG. 2, in accordance with the invention, shown in an upright collapsed position.

Referring to FIGS. 2 and 3, a marker cone 20 in accordance with the invention, includes a base portion 22 and a cone portion 24. Unlike the prior art marker cone 10, the cone portion 24 of the present invention includes one or more weakened regions. These regions weaken the inherent structural strength of the cone and lessen the magnitude of vertical force required to collapse the cone portion 24 along the vertical axis. Preferably, the weakened regions are provided as vertically disposed weakened portions, i.e., slots 26. The marker cone 20, in accordance with the invention, will collapse under little vertical force, or horizontal force, and will therefore cause minimal or no injury to a falling person, regardless of the direction and angle of the fall. A collapsed cone 20, in accordance with the present invention, is shown in FIG. 3. The cone portions 28 between the vertical slots 26 tend to bend outwardly upon application of a downward force to the top of the cone, thereby causing collapse of the cone.

Although the present marker cone 20 will easily collapse under the weight of a falling person, its structure is otherwise sufficiently resilient to maintain a vertical, upright orientation (such as that shown in FIG. 2), prior to the application of a collapsing force (i.e., a person falls on top of the cone) and the memory characteristics of the plastic used ensure that the original conical shape is restored after such a collapsing force is removed.

The slots 26 are preferably evenly spaced about the cone portion, such that a vertical component of each slot 26 is parallel to each other, and parallel to the vertical axis of the cone 20, as shown in FIG. 2. As shown in FIG. 2, each slot 26 tapers from a maximum width adjacent the base portion 22 to a minimum width adjacent the top of the cone portion 24. However, the slots 26 may be any size and shape to provide the necessary weakening of the cone portion 24 along the vertical axis, as described above. The slots 26 may be formed as slits or cuts (not shown). Alternatively, the cone portion 24 may be weakened by thinning selective areas of the wall forming the cone portion 24.

In the preferred embodiment the base is approximately a 5¼" square, the cone portion is approximately 9 inches in height and has a base diameter of approximately 5" diameter and a approximately ⅞ inch diameter truncated tip. Preferably, the conical portion is about 1/16 inch thick flexible plastic material, such as low density polyethylene. Other materials having similar flexibility or shore hardness therefor can be used such as rubber based materials, polypropylene and PVC. In this preferred embodiment, 6 vertical slots are evenly disposed about the cone so that a vertical force of approximately 20 pounds causes the cone to substantially fully collapse vertically. Of course, greater or fewer slots may be provided depending on the particular material used and the specific dimensions of the cone.

In the preferred embodiment, the material located between the slots 26 of the cone portion 24 provides sufficient visual surface area to function as an effective marker.

Although the preferred embodiment includes straight vertical slots 26 which effectively weaken the structural integrity of the cone, along the vertical axis, as described above, the cone may similarly be structurally weakened in a controlled manner through the use of a single or multiple slots formed in a spiral pattern about the cone. Circular openings randomly positioned, or following a predetermined pattern about the cone, may also be used in place of the slots 26.

The result is a marker cone which provides the appropriate marking necessary for various sporting events, including football, basketball, field hockey, soccer, ice hockey, and the like, without jeopardizing the safety of anyone accidentally falling directly on top of any of the marker cones.

What is claimed is:

1. A marker cone comprising:

a unitary conical portion including a tip end spaced from a base end and including selectively weakened regions, said weakened regions allowing said conical portion to collapse along a vertical axis of said conical portion in response to a predetermined force being applied to said conical portion along said vertical axis, said weakened regions including slots extending substantially from said base end to said tip end, said slots including adjacent slots wherein a distance of said conical portion between said adjacent slots is smaller proximate to said tip end than a distance of said conical portion between said adjacent slots proximate to said base end.

2. The marker cone according to claim 1, wherein said slots comprise openings in said conical portion.

3. The marker cone according to claim 2, wherein the slots are evenly distributed about the conical portion.

4. The marker cone according to claim 1, wherein said predetermined force is less than 20 pounds.

5. The marker cone according to claim 1, wherein said slots are distributed peripherally about said conical portion.

6. The marker cone according to claim 1, wherein said conical portion is polyethylene.

7. The marker cone according to claim 6, wherein said conical portion is low density polyethylene.

8. The marker cone according to claim 1, wherein said conical portion is approximately 9 inches in height and has a base diameter of approximately 5 inches and an approximately ⅞ inch diameter truncated tip.

9. A marker cone according to claim 1, further comprising a horizontal base portion supporting said unitary conical portion.

10. A marker cone according to claim 1, wherein said unitary conical portion is a one-piece assembly.

11. A marker cone according to claim 1, wherein said conical portion has a sheet-like surface including an inner surface facing the interior of said conical portion and an outer surface facing the exterior of said conical portion.

12. A marker cone according to claim 11, wherein said weakened regions comprise a minority of said conical portion and said sheet like surface comprises a majority of said conical portion.

* * * * *